US009558698B2

(12) United States Patent
Chen et al.

(10) Patent No.: US 9,558,698 B2
(45) Date of Patent: Jan. 31, 2017

(54) DATA DRIVER AND DISPLAY DEVICE DRIVING METHOD

(71) Applicant: AU Optronics Corp., Hsin-Chu (TW)

(72) Inventors: Wei-Jyun Chen, Hsin-Chu (TW); Chun-Fan Chung, Hsin-Chu (TW); Szu-Che Yeh, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/566,672

(22) Filed: Dec. 10, 2014

(65) Prior Publication Data

US 2015/0287374 A1 Oct. 8, 2015

(30) Foreign Application Priority Data

Apr. 8, 2014 (TW) ..... 103112893 A

(51) Int. Cl.
*G09G 3/36* (2006.01)

(52) U.S. Cl.
CPC ..... *G09G 3/3614* (2013.01); *G09G 3/3648* (2013.01); *G09G 3/3688* (2013.01); *G09G 2310/0248* (2013.01)

(58) Field of Classification Search
CPC ... G09G 3/3688; G09G 3/3614; G09G 3/3648
USPC ..... 345/98–99
See application file for complete search history.

(56) References Cited

U.S. PATENT DOCUMENTS

2006/0290638 A1* 12/2006 Kang ..... G09G 3/2011 345/98
2007/0013573 A1* 1/2007 Hashimoto ..... G09G 3/3614 341/172
2009/0002302 A1* 1/2009 Koo ..... G09G 3/3614 345/89
2011/0316901 A1 12/2011 Park
2013/0127806 A1 5/2013 Wu et al.

FOREIGN PATENT DOCUMENTS

CN 100514404 C 7/2009
CN 102436789 A 5/2012

* cited by examiner

*Primary Examiner* — Kwin Xie
(74) *Attorney, Agent, or Firm* — WPAT, PC; Justin King

(57) ABSTRACT

A driving method for driving a display apparatus including a plurality of pixels, a plurality of data lines and a data driver. The data driver includes a first latch outputting a first sample data signal to a second latch, the second latch, a first charge sharing line and a second charge sharing line. The method includes performing a first charge sharing when a polarity of one of the pixels changes so as to output a first calibrated data signal to the data line electrically coupled to the pixel, and executing a second charge sharing when the most significant bit of the first sample data signal is different from the most significant bit of the second sample data signal so as to output a second adjusted data signal to the data line.

10 Claims, 15 Drawing Sheets

DATA DRIVER AND DISPLAY DEVICE DRIVING METHOD

BACKGROUND OF THE INVENTION

1. Field of the Invention

The present invention relates to a driving method for driving a display device, and in particularly, a driving method performed by using a data driver.

2. Description of the Prior Art

According to the prior art, each pixel coupled to each data line of a display device has a common voltage signal respectively for defining its polarity. For example, if a voltage level of a common voltage signal of a pixel is higher than a predetermined voltage level, a polarity of the pixel is positive; and if the voltage level of the common voltage signal of the pixel is lower than a predetermined voltage level, the polarity of the pixel is negative. In order to prevent unclear display caused by electric charge accumulation, a display panel should perform a polarity switching after finishing each frame period, that is to switch the polarity of each pixel and a data line coupled to the pixel from being positive to being negative or from being negative to being positive.

However, due to demand for higher resolution of display devices, the reserved charging/discharging time is no longer long enough for a data voltage level of a data line to be switched from an original voltage level to a target voltage level, and a long voltage level switching time leads to the power consumption being too high. Hence, how to reduce the charging/discharging time of a data voltage level and reduce the power consumption required by a data driver are problems to be solved.

FIG. 1 illustrates signal waveforms when performing charge sharing according to the prior art. In FIG. 1, a first data line voltage level $V_{Y1}$ and a second data line voltage level $V_{Y2}$ are voltage levels of two adjacent data lines respectively. When a common voltage signal POL does not change yet, the first data line voltage level $V_{Y1}$ is positive, and the second data line voltage level $V_{Y2}$ is negative. When the common voltage signal POL changes, for example, from a low voltage level to a high voltage level, this means that a polarity of a data line changes, and a frame period finishes for the display device to enter a next frame period, the first data line voltage level $V_{Y1}$ changes from positive to negative, and the second data line voltage level $V_{Y2}$ changes from negative to positive. When the common voltage signal POL is detected to switch, a control signal STB is enabled to be at a high voltage level (within a time interval t1 shown in FIG. 1), a switch is turned on accordingly so as to couple a first data line and a second data line to a charge share line for the first data line voltage level $V_{Y1}$ and the second data line voltage level $V_{Y2}$ to be pulled to a charge sharing voltage level. As shown in FIG. 1, the charge sharing voltage level HAVDD is half the power supply voltage. The first data line voltage level $V_{Y1}$ and the second data line voltage level $V_{Y2}$ are then pulled to two target voltage levels, i.e. the first data line target voltage level $V_{target\text{-}Y1}$ and the second data line target voltage level $V_{target\text{-}Y2}$, respectively, according to the data inputted to the data lines. Performing the described charge sharing in the interval of the switching of polarity may shorten the required time for the first data line voltage level $V_{Y1}$ and the second data line voltage level $V_{Y2}$ to be pulled to the first data line target voltage level $V_{target\text{-}Y1}$ and the second data line target voltage level $V_{target\text{-}Y2}$ respectively so as to reduce the power consumption. According to prior art, the charge sharing is merely performed when the polarity of the pixels and the data line coupled to the pixels changes. However, taking the time interval t2 and the time interval t3 for example, the polarity of the data line does not change in the time intervals t2 and t3 so that the charge sharing is not performed for reducing the power consumption. In particularly, if the change of the first data line voltage level $V_{Y1}$ or the second data line voltage level $V_{Y2}$ is larger, more time is necessary for pulling them to the target voltage levels, and power consumption is therefore greater.

SUMMARY OF THE INVENTION

An embodiment of the present invention discloses an electric charge share device, electrically connected to a data driver and a data line, comprising a data detection unit, a first charge share line, a second charge share line and a data signal charge share unit. The data detection unit is configured to determine if a most-significant-bit of a first sample data signal from the data driver is identical to a most-significant-bit of a second sample data signal from the data driver. The data signal charge share unit is configured to receive a data signal from the data driver, and electrically connected to the data detection unit, the first charge share line and the second charge share line. When the most-significant-bit of the first sample data signal is not identical to the most-significant-bit of the second sample data signal, the data line is selectively coupled to the first charge share line or the second charge share line according to a polarity of a common voltage signal of a pixel connected to the data line.

Another embodiment of the present invention discloses a data driver, electrically connected to a data line, comprising a first latch, a second latch, a digital-to-analog convertor, a first charge share line, a second charge share line, and a data signal charge share unit. The first latch is configured to output a first sample data signal. The second latch is electrically connected to the first latch and configured to output a second sample data signal. The digital-to-analog convertor is electrically connected to the second latch and configured to output a data signal to a pixel coupled to the data line. The data detection unit is coupled to the first latch and the second latch and configured to receive the first sample data signal and the second sample data signal. The data signal charge share unit is coupled to the data line, the data detection unit, the first charge share line and the second charge share line. When the most-significant-bit of the first sample data signal is not identical to the most-significant-bit of the second sample data signal, the data line is selectively coupled to the first charge share line or the second charge share line according to a polarity of a common voltage signal of the pixel coupled to the data line.

Another embodiment of the present invention discloses a driving method for driving a display device, the display device comprising a plurality of pixels, a plurality of data lines and a data driver configured to output a plurality of data signals. The data driver comprises a first latch configured to output a first sample data signal to a second latch, the second latch configured to output a second sample data signal, and at least a charge share line. The method comprises performing charge sharing among one of the data signals and one of the charge share lines so as to output a first calibrated data signal to one of the data lines when a most-significant-bit of the first sample signal is not identical to a most-significant-bit of the second sample signal.

These and other objectives of the present invention will no doubt become obvious to those of ordinary skill in the art after reading the following detailed description of the preferred embodiment that is illustrated in the various figures and drawings.

DETAILED DESCRIPTION

According to the prior art described above, when a polarity of a data line and pixels coupled to the data line changes, charge sharing may be performed for speeding up the process of changing the voltage level on the data line and the pixels coupled to the data line so as to reduce the power consumption, however, the charge sharing is not performed if the polarity of the data line and the pixels coupled to the data line does not change. However, according to the data driver and the display device driving method disclosed by the present invention, if a most-significant-bit (MSB) of a data signal used for the pixels to display changes, the charge sharing is accordingly performed. In other words, the charge sharing is allowed to be performed even when the polarity of the common voltage signal of the pixels does not change. Hence, the required time and power consumption for changing the voltage level of the data line and the pixels are reduced.

Figure 1:
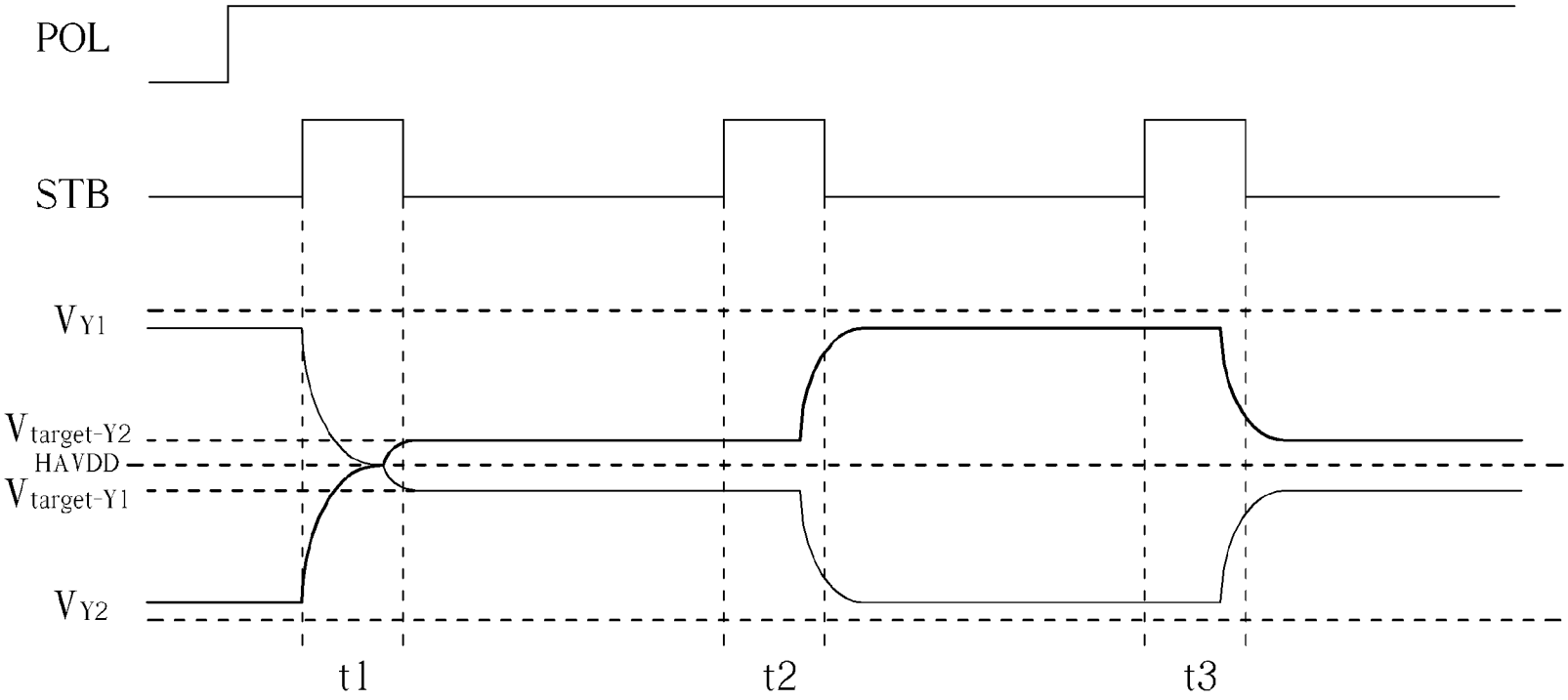
FIG. 1 PRIOR ART
FIG. 1 illustrates signal waveforms when performing charge sharing according to the prior art.
Figure 2:
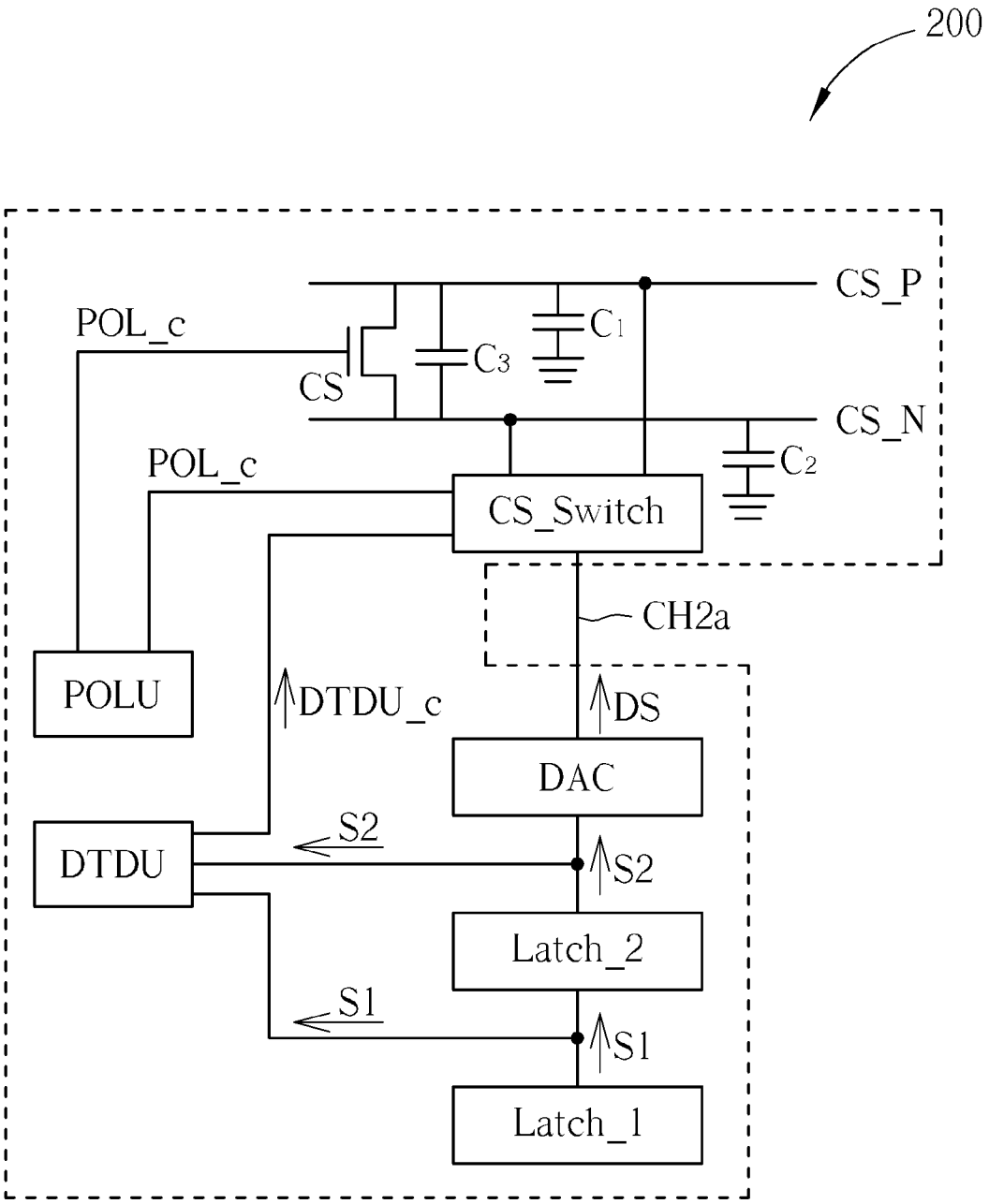
FIG. 2 illustrates a functional block diagram of a data driver according to an embodiment of the present invention.

FIG. 2 illustrates a functional block diagram of a data driver 200 according to an embodiment of the present invention. As shown in FIG. 2, the data driver 200 is electrically connected to a data line CH2*a*, and the data driver 200 includes a first latch Latch_1, a second latch Latch_2, a digital-to-analog convertor DAC, a data detection unit DTDU, a first charge share line CS_P, a second charge share line CS_N, a charge share unit CS and a data signal charge share unit CS_Switch. The first latch Latch_1 is configured to output a first sample data signal S1. The second latch Latch_2 is electrically connected to the first latch Latch_1 and configured to output a second sample data signal_S2 according to the first sample data signal S1. The digital-to-analog convertor DAC is electrically connected to the second latch Latch_2 and configured to output a data signal DS to a pixel (not shown in FIG. 2) coupled to the data line CH2*a*. The data detection unit DTDU is coupled to the first latch Latch_1 and the second latch Latch_2 and configured to receive the first sample data signal S1 and the second sample data signal S2 for checking bit values of the first and second sample data signals S1 and S2. The data signal charge share unit CS_Switch is coupled to the data line CH2*a*, the data detection unit DTDU, the first charge share line CS_P and the second charge share line CS_N. The data detection unit DTDU is configured to control the data signal charge share unit CS_Switch for the data line CH2*a* to be coupled to the first and second charge share lines CS_P and CH_N when a polarity of a common voltage signal of the pixel changes. The data detection unit DTDU is also configured control the data signal charge share unit CS_Switch so that the data line CH2*a* is selectively coupled to the first charge share line CS_P or the second charge share line CS_N according to the polarity of the common voltage signal of the pixel when the most-significant-bit (MSB) of the first sample data signal S1 is not identical to the MSB of the second sample data signal S2 and a control signal STB (not shown in FIG. 2) is enabled to be to be at a high voltage level. The MSBs of the first and the second sample data signals S1 and S2 are compared with one another by the data detection unit DTDU, and the data detection unit DTDU outputs a corresponding data variation signal DTDU_c (e.g. a 1-bit 1) when the MSBs of the first and the second sample data signals S1 and S2 are not identical. According to an embodiment of the present invention, when the polarity of the pixel is positive, the first charge share line CS_P is electrically connected to the data line CH_a; and when the polarity of the pixel is negative, the second charge share line CS_N is electrically connected to the data line CH_a. The data driver 200 also includes a polarity switch detection unit POLU configured to detect whether the polarity of the common voltage signal POL changes, for example, from a high voltage level to a low voltage level or vice versa, that is to detect whether the polarity of the data line CH2*a* and the pixel coupled to the data line CH2*a* changes. If the polarity changes, the polarity switch detection unit POLU outputs a polarity switch signal POL_c (e.g. a 1-bit 1) to the charge share unit CS and the data signal charge share unit CS_Switch in order to turn on the charge share unit CS and a switch inside the data signal charge share unit CS_Switch (described below). The said control signal STB is a synchronous signal used to control the time of charge sharing, but another external control signal is allowed to be used for controlling the time of charge sharing according to another embodiment of the present invention. Furthermore, as shown in FIG. 2, a capacitor C1 may be coupled between the first charge share line CS_P and a ground, a capacitor C2 may be coupled between the second charge share line CS_N and the ground, and a capacitor C3 may be coupled between the first charge share line CS_P and the second charge share line CS_N in order to stabilize voltage levels.

Figure 3:
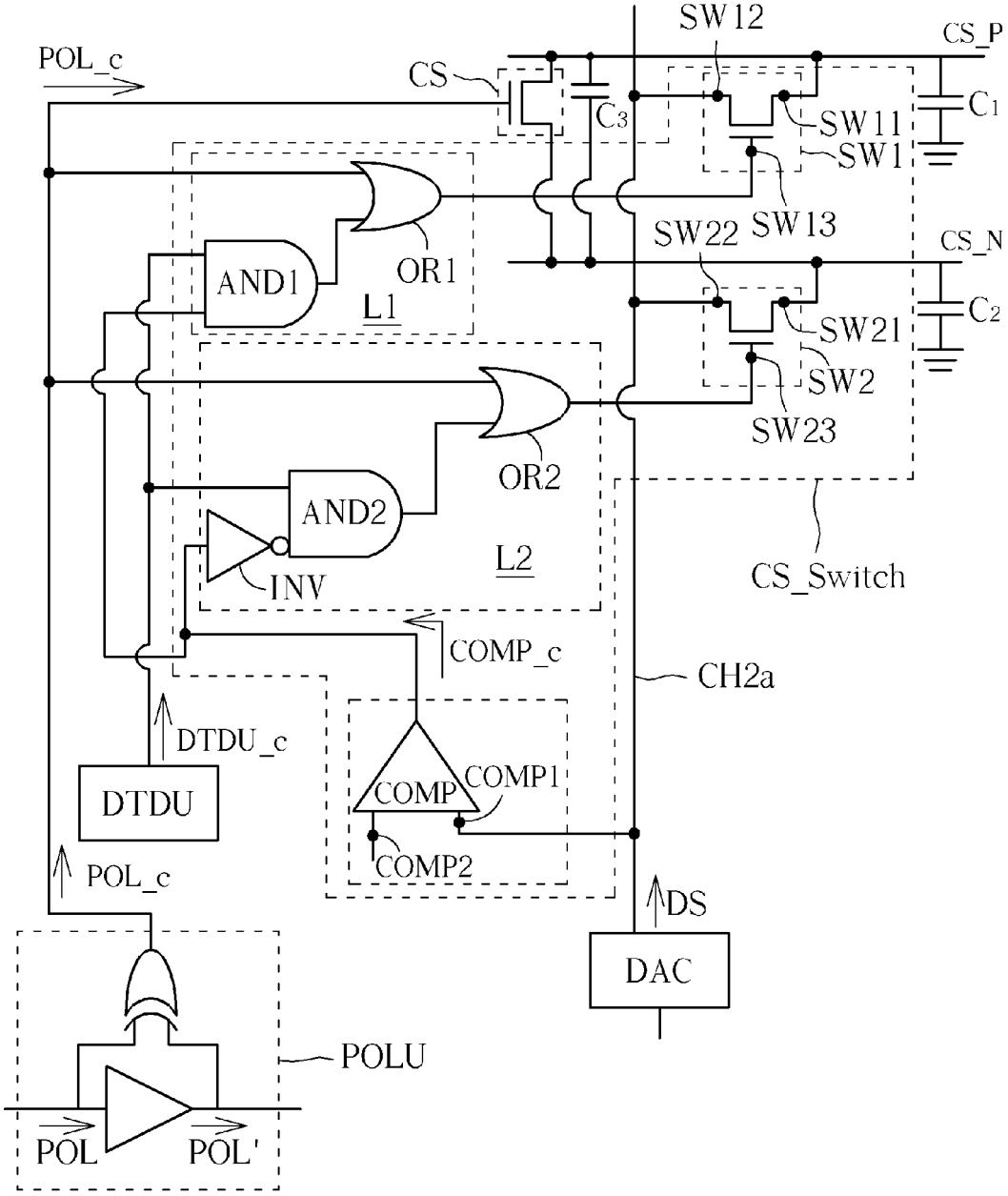
FIG. 3 illustrates a part of the data driver shown in FIG. 2.

FIG. 3 illustrates a part of the data driver 200 shown in FIG. 2. As shown in FIG. 3, the data signal charge share unit CS_Switch includes a first switch SW1, a second switch SW2, a first logic unit L1, a second logic unit L2 and a polarity comparator COMP.

The first switch SW1 includes a first terminal SW11 coupled to the first charge share line CS_P, a second terminal SW12 coupled to the data line CH2*a*, and a control terminal SW13. The second switch SW12 includes a first terminal SW21 coupled to the second charge share line CS_N, a second terminal SW22 coupled to the data line CH2*a*, and a control terminal SW23. An output terminal of the first logic unit L1 is coupled to the control terminal SW13 to control if the first switch SW1 is turned on according to a polarity of the data line CH2*a*, whether the polarity of the data line CH2*a* changes, and whether a difference between the first sample data signal S1 and the second sample data signal S2 is greater than a predetermined value. The second logic unit L2 is coupled to the control terminal SW23 and configured to control if the second switch SW2 is turned on according to the polarity of the data line CH2*a*, whether the polarity of the data line CH2*a* changes, and whether the difference between the first sample data signal S1 and the second sample data signal S2 is greater than the predetermined value.

With respect to the polarity of the data line CH2*a* (i.e. the polarity of the pixel coupled to the data line CH2*a*), the polarity may be detected by the polarity switch detection unit POLU shown in FIG. 3 according to an embodiment of the present invention. The polarity switch detection unit POLU includes a latch and an exclusive-OR gate (XOR gate), wherein the latch is used to receive the most updated common voltage signal POL and output the previous common voltage signal POL' released after being latched, and the XOR gate is used to compare the common voltage signal POL and the previous common voltage signal POL' so as to output the polarity switch signal POL_c. If the common voltage signal POL is not identical to the previous common voltage signal POL', this means the common voltage signal POL falls from a high voltage level (corresponding to a positive polarity) down to a low voltage level (corresponding to a negative polarity) or rises from the low voltage level up to the high voltage level, and the value of the polarity switch signal POL_c may change to (but not limited to) a 1-bit 1 from a 1-bit 0 accordingly. Since the polarity switch signal POL_c is outputted to the charge share unit CS and the data signal charge share unit CS_Switch, the charge share unit CS and the data signal charge share unit CS_Switch may be informed of the changing of the polarity when the polarity switch signal POL_c changes. The said common voltage signal POL may be outputted from a graphics processor unit (GPU) in a display device, and the common voltage signal POL may change when a frame period has finished and a new frame period is just beginning. The common voltage signal POL may change according to the necessary polarity set for the pixel coupled to the data line CH2*a*.

According to an embodiment of the present invention, when the polarity of the data line CH2*a* changes, that is, when the polarity of the pixel coupled to the data line CH2*a* changes to positive from negative or from negative to positive, the charge share unit CS may be enabled and the first switch SW1 and the second switch SW2 may be turned on so that the first charge share line CS_P, the second charge share line CS_N and the data line CH2*a* may be coupled to one another, and this operation may be called a first charge sharing. When the polarity of the data line CH2*a* does not change, that is, when the common voltage signal POL keeps to be at the high voltage level or the low voltage level, the data detection unit DTDU may compare the first sample data signal S1 with the second sample data signal S2, and if the MSB of the first sample data signal S1 is not identical to the MSB of the second sample data signal S2, this means that the difference from the second sample data signal S2 to the first sample data signal S1 is greater than a predetermined value, and the variation of the voltage level on the data CH2*a* is great enough, the data detection unit DTDU may therefore output the data variation signal DTDU_c (e.g. a 1-bit 1) accordingly. According to the embodiment shown in FIG. 2 and FIG. 3, when the polarity of the data line CH2*a* does not change and the variation of the voltage level on the data line CH2*a* is great enough, the first switch SW1 is turned on to electrically connect the first charge share line CS_P and the data line CH2*a* if the polarity of the data line CH2*a* is positive and when the second switch SW2 is turned on to electrically connect the second charge share line CS_N and the data line CH2*a* if the polarity of the data line CH2*a* is negative. The polarity of the data line CH2*a* is determined to be positive or negative by the polarity comparator COMP. According to the embodiment shown in FIG. 3, the polarity comparator COMP includes a first terminal COMP1 coupled to the data line CH2*a*, a second terminal COMP2 coupled to a predetermined voltage level, and an output terminal coupled to the first logic unit L1 and the second logic unit L2. When a voltage level on the data line CH2*a* is higher than the predetermined voltage level, the polarity of the data line CH2*a* is determined to be positive, and the polarity comparator COMP may output a polarity compare signal COMP_c (e.g. a 1-bit 1) accordingly. When a voltage level on the data line CH2*a* is lower than the predetermined voltage level, the polarity of the data line CH2*a* is determined to be negative, and the polarity comparator COMP may output the polarity compare signal COMP_c (e.g. a 1-bit 0) accordingly. According to embodiments of the present invention, the predetermined voltage level used to determine the polarity may be half the Gamma voltage, half the power supply voltage or determined according to specifications of product or statistic results from experiments. The Gamma voltage mentioned above is a pixel voltage corresponding to greyscale. For example, when a display device may display with 256 greyscales, a constant N is allowed to be set as 256, and the half value of the Gamma voltage is allowed to be written as $VGAMMA_{N/2}$, i.e. $VGAMMA_{128}$, a pixel voltage corresponding to the 128th greyscale of 256 greyscales.

According to FIG. 3, the first logic unit L1 includes an OR-gate OR1 and an AND-gate AND1. The OR-gate OR1 includes a first input terminal for receiving the polarity switch signal POL_c so as to be informed whether the polarity of the data line CH2*a* changes, a second input terminal, and an output terminal coupled to the control terminal SW13. The AND-gate AND1 includes a first input terminal coupled to the data detection unit DTDU for receiving the data variation signal DTDU_c, a second input terminal coupled to the polarity comparator COMP, and an output terminal coupled to the second input terminal of the OR-gate OR1. The second logic unit L2 includes an OR-gate OR2, an AND-gate AND2 and an inverter INV. The OR-gate OR2 includes a first input terminal configured to receive the polarity switch signal POL_c so as to be informed whether the polarity of the data line CH2*a* and the pixels coupled to the data line CH2*a* changes, a second input terminal, and an output terminal coupled to the control terminal SW23. The AND-gate AND2 includes a first input terminal coupled to the data detection unit DTDU for receiving the data variation signal DTDU_c, a second input terminal, and an output terminal coupled to the second input terminal of the OR-gate OR2. The inverter INV includes an input terminal coupled to the polarity comparator COMP, and an output terminal coupled to the second input terminal of the AND-gate AND2. With the first logic unit L1 and the second logic unit L2, the following operations may be performed:

(a) When the polarity of the data line CH2*a* and the pixel coupled to the data line CH2*a* changes, the polarity switch signal POL_c may be a 1 so as to turn on the charge share unit CS, the first switch SW1 and the second switch SW2;

(b) When the polarity of the data line CH2*a* and the pixel coupled to the data line CH2*a* does not change, and the data variation signal DTDU_c is a 0, that is to say that the difference from the first sample data signal S1 to the second sample data signal S2 is smaller than a predetermined value, neither the first switch SW1 nor the second switch SW2 is turned on;

(c) When the polarity of the data line CH2*a* and the pixel coupled to the data line CH2*a* changes, and the data variation signal DTDU_c is a 1, that is to say that the difference from the first sample data signal S1 to the second sample data signal S2 is greater than the predetermined value, and the variation of the voltage level on the data line CH2*a* is larger. If the data signal DS has a voltage level higher than a predetermined voltage level, the polarity of the data line CH2*a* may be determined to be positive, and the first switch SW1 is turned on for electrically connecting the data line CH2*a* to the first charge share line CS_P. If the data signal DS has a voltage level lower than the predetermined voltage level, the polarity of the data line CH2*a* may be determined to be negative, and the second switch SW2 is turned on for electrically connecting the data line CH2*a* to the second charge share line CS_N.

Figure 4:
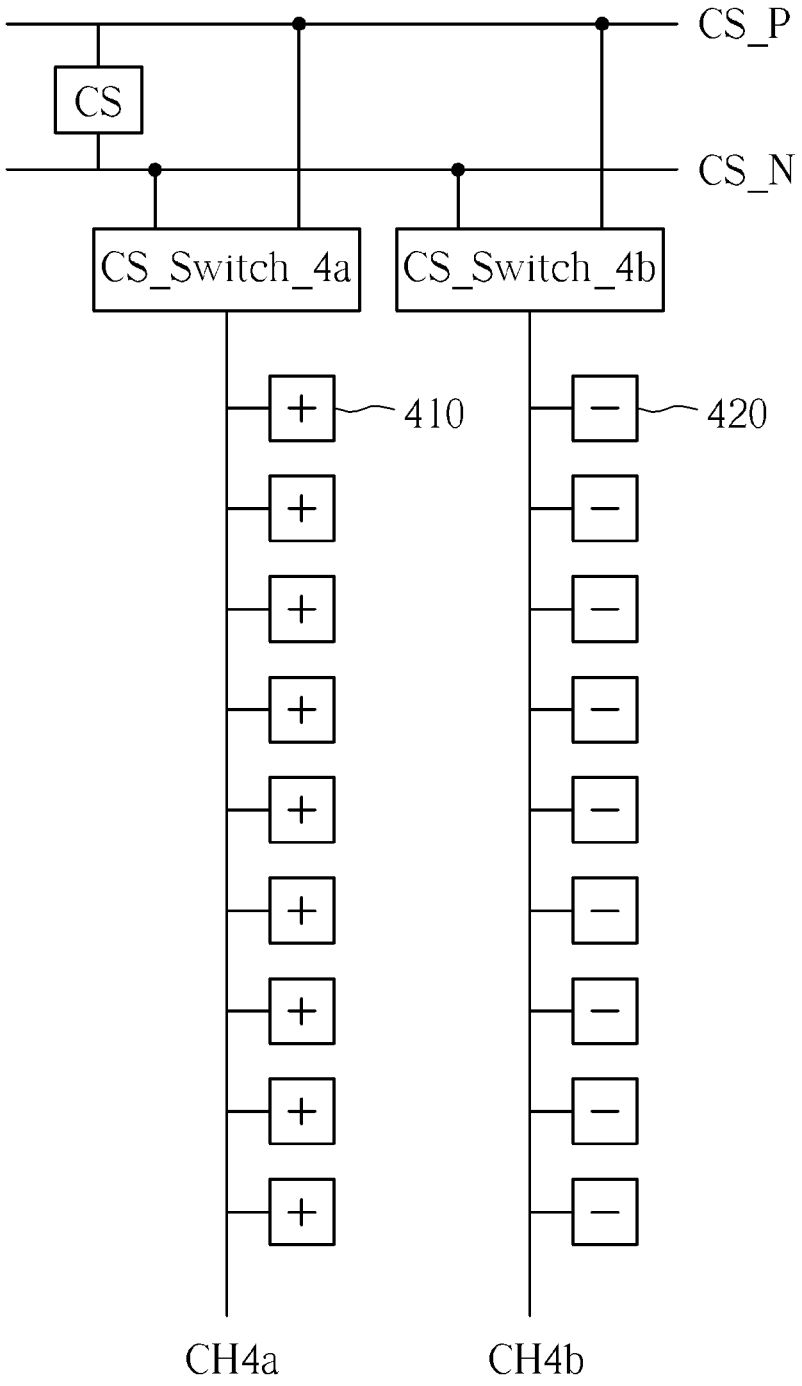
FIG. 4 illustrates a plurality of pixels coupled to two data lines according to an embodiment of the present invention.

FIG. 4 illustrates a plurality of pixels 410 coupled to a data line CH4*a* and a plurality of pixels 420 coupled to a data line CH4*b* according to an embodiment of the present invention. The data line CH4*a* may be coupled to the first charge share line CS_P and the second charge share line CS_N through a data signal share unit CS_Switch_4*a*, and the data line CH4*b* may be coupled to the first charge share line CS_P and the second charge share line CS_N through a data signal share unit CS_Switch_4*b*.

Figure 5:
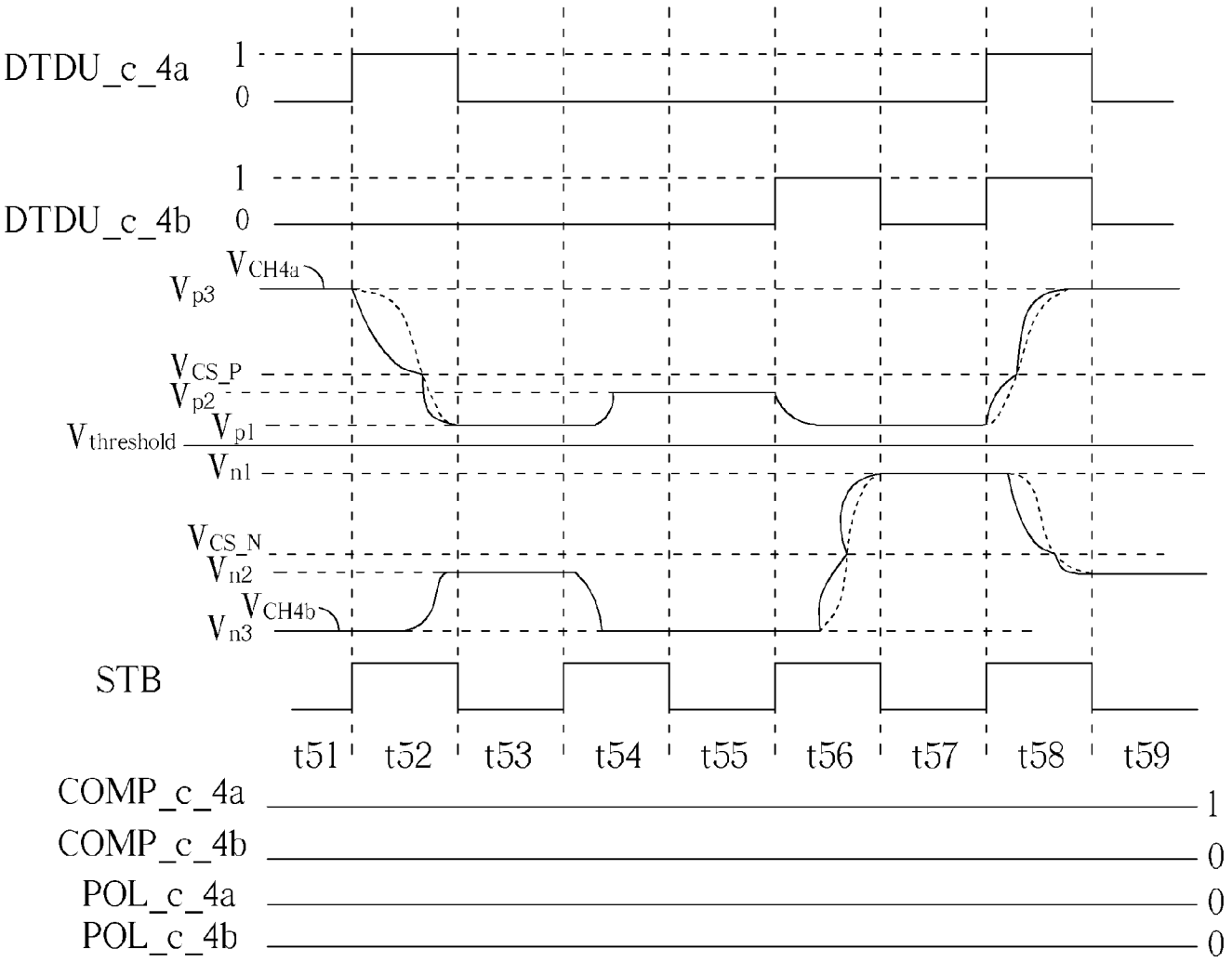
FIG. 5 illustrates a waveform diagram of signals of the data lines and the data driver shown in FIG. 4.

FIG. 5 illustrates a waveform diagram of signals of the data line CH4*a*, the data line CH4*b* and the data driver shown in FIG. 4. The data line CH4*a* and the data line CH4*b* are adjacent to one another. The pixels 410 coupled to the data line CH4*a* are of positive polarity and marked with "+" symbol. The pixels 420 coupled to the data line CH4*b* are of negative polarity and marked with "−" symbol. The waveform diagram includes signals and voltage levels shown in the following table 1.

| Signals and voltage levels shown in FIG. 5 | Description |
|---|---|
| Data line voltage level $V_{CH4a}$ | A data line voltage level on the data line CH4a |
| Data line voltage level $V_{CH4b}$ | A data line voltage level on the data line CH4b |
| Predetermined voltage level $V_{threshold}$ | For determining the positive polarity and the negative polarity |
| First charge share voltage level $V_{CS_P}$ | A voltage level set on the first charge share line CS_P |
| Second charge share voltage level $V_{CS_N}$ | A voltage level set on the second charge share line CS_N |
| Control signal STB | When the control signal STB is enabled to be at a high voltage level, voltage levels on the data lines change. |
| Polarity compare signal COMP_c_4a | The polarity compare signal COMP_c_4a is the result of comparing the data signal on the data line CH4a with the predetermined voltage level $V_{threshold}$. The polarity compare signal COMP_c_4a is 1 means that the polarity of the data line CH4a is positive, and the polarity compare signal COMP_c_4a is 0 means that the polarity of the data line CH4a is negative. |
| Polarity compare signal COMP_c_4b | The polarity compare signal COMP_c_4b is the result of comparing the data line voltage level $V_{CH4b}$ with the predetermined voltage level $V_{threshold}$. The polarity compare signal COMP_c_4b is 1 means that the polarity of the data line CH4b is positive, and the polarity compare signal COMP_c_4b is 0 means that the polarity of the data line CH4b is negative. |
| Data variation signal DTDU_c_4a | The data variation signal DTDU_c_4a means the variation of data on the data line CH4a. The data variation signal DTDU_c_4a is 1 means that the data variation on the data line CH4a is larger than a predetermined value, and the data variation signal DTDU_c_4a is 0 means that the data variation on the data line CH4a is smaller than the predetermined value. |
| Data variation signal DTDU_c_4b | The data variation signal DTDU_c_4b means the variation of data on the data line CH4b. The data variation signal DTDU_c_4b is 1 means that the data variation on the data line CH4b is larger than a predetermined value, and the data variation signal DTDU_c_4b is 0 means that the data variation on the data line CH4b is smaller than the predetermined value. |
| Polarity switch signal POL_c_4a | The polarity switch signal POL_c_4a shows whether the polarity of the data line CH4a changes. When the polarity of the data line CH4a changes (from positive to negative or vice versa), the polarity switch signal POL_c_4a is 1. When the polarity of the data line CH4a without changing, the polarity switch signal POL_c_4a is 0. |
| Polarity switch signal POL_c_4b | The polarity switch signal POL_c_4b shows whether the polarity of the data line CH4b changes. When the polarity of the data line CH4b changes (from positive to negative or vice versa), the polarity switch signal POL_c_4b is 1. When the polarity of the data line CH4b without changing, the polarity switch signal POL_c_4b is 0. |

(table 1, descriptions of signals and voltage levels according to an embodiment of the present invention)

Refer to table 1 with FIG. 5. Since the polarity switch signals POL_c_4*a* and POL_c_4*b* keep 0, it is known that neither the polarity of the data line CH4*a* nor the polarity of the data line CH4*b* changes within the time intervals t51 to t59. Since the polarity compare signal COMP_c_4*a* is 1, and the polarity compare signal COMP_c_4*b* is 0, it is known that the polarity of the data line CH4*a* and pixels coupled to the data line CH4*a* is positive, and the polarity of the data line CH4*b* and pixels coupled to the data line CH4*b* is negative. Within the time intervals t52, t54, t56 and t58, since the control signal STB is 1, the data line voltage levels on the data line CH4*a* and the data line CH4*b* change accordingly. Within the time interval t52, the data line voltage level $V_{CH4a}$ changes from a voltage level Vp3 to a voltage level Vp1, and the data line voltage level $V_{CH4b}$ changes from a voltage level Vn3 to a voltage level Vn2. Within the time interval t54, the data line voltage level $V_{CH4a}$ changes from the voltage level Vp1 to a voltage level Vp2, and the data line voltage level $V_{CH4b}$ changes from the voltage level Vn2 to the voltage level Vn3. Within the time interval t56, the data line voltage level $V_{CH4a}$ changes from the voltage level Vp2 to the voltage level Vp1, and the data line voltage level $V_{CH4b}$ changes from the voltage level Vn3 to a voltage level Vn1. Within the time interval t58, the data line voltage level $V_{CH4a}$ changes from the voltage level Vp1 to the voltage level Vp3, and the data line voltage level $V_{CH4b}$ changes from the voltage level Vn1 to the voltage level Vn2.

According to an embodiment of the present invention shown in FIG. 5, when the data line voltage level $V_{CH4a}$ changes from the voltage level Vp3 to the voltage level Vp1 so that the variation, i.e. the amount of changing, is larger than the predetermined value within the time interval t52, for example, two MSBs of two greyscale values corresponding to the voltage level Vp3 and the voltage level Vp1 respectively are not identical, the data variation signal DTDU_c_4*a* changes to be 1 within the time interval t52. Similarly, within the time interval t58, the data variation signal DTDU_c_4*a* is 1 since the variation of the data line voltage level $V_{CH4a}$ of the data line CH4*a* is larger than the predetermined value. Similarly, within the time intervals t56 and t58, the data variation signal DTDU_c_4*b* is 1 since the variation of the data line voltage level $V_{CH4b}$ of the data line CH4*b* is larger than the predetermined value. According to the embodiment of the present invention, within the time intervals t52 and t58, the data variation signal DTDU_c_4*a* is 1 and the polarity compare signal COMP_c_4*a* is 1 so that a second charge sharing is performed for turning on the first switch of the data signal charge share unit CS_Switch_4*a* to electrically connect the data line CH4*a* to the first charge share line CS_P. Within the time intervals t56 and t58, the data variation signal DTDU_c_4*b* is 1 and the polarity compare signal COMP_c_4*a* is 0 so that a second charge sharing is performed for turning on the second switch of the data signal charge share unit CS_Switch_4*b* to electrically connect the data line CH4*b* to the first charge share line CS_N.

The second charge sharing mentioned above is different from the prior art since the second charge sharing of the present invention is not performed when the frame period changes or when the polarity of a data line and pixels coupled to the data line changes, but the second charge sharing is performed when the polarity does not change but the variation of the voltage level of the data line and the pixels coupled to the data line is larger than a predetermined value so as to speed up the process of changing the voltage level on the data line for reducing power consumption and operation time. When the polarity of the data line and the pixel coupled to the data line changes, the charge share unit CS is turned on for electrically connecting the first charge share line CS_P and the second charge share line CS_N to become one charge share line, and a first and a second switches of a data signal charge share unit are both turned on for connecting the data line to the first charge share line CS_P and the second charge share line CS_N, a charge sharing similar to the prior art may be performed, and this may be called a first charge sharing according to an embodiment of the present invention. Regarding each data line such as the data lines CH4*a* or CH4*b* shown in FIG. 4 and FIG. 5, it is allowed to independently decide whether performing the first charge sharing and/or the second charge sharing for the data line according to a polarity compare signals, a data variation signals and a polarity switch signal disclosed by the present invention without considering and affecting other data lines. Furthermore, the mentioned predetermined voltage level $V_{threshold}$ may be half the power supply voltage or half the Gamma voltage (which is allowed to be written as $VGAMMA_{N/2}$), the mentioned first charge share voltage level $V_{CS_P}$ may be ¾ the Gamma voltage (which is allowed to be written as $VGAMMA_{3N/4}$) and the mentioned second charge share voltage level $V_{CS_N}$ may be ¼ the Gamma voltage (which is allowed to be written as $VGAMMA_{N/4}$). For example, when a display device may display with 256 greyscales, a constant N is allowed to be set as 256, half the Gamma voltage ($VGAMMA_{N/2}$) is $VGAMMA_{128}$ corresponding to the 128th greyscale of 256 greyscales, and ¾ the Gamma voltage ($VGAMMA_{3N/4}$) and ¼ the Gamma voltage ($VGAMMA_{N/4}$) are $VGAMMA_{192}$ and $VGAMMA_{64}$ corresponding to the $192^{nd}$ greyscale and the $64^{th}$ greyscale respectively.

Figure 6:
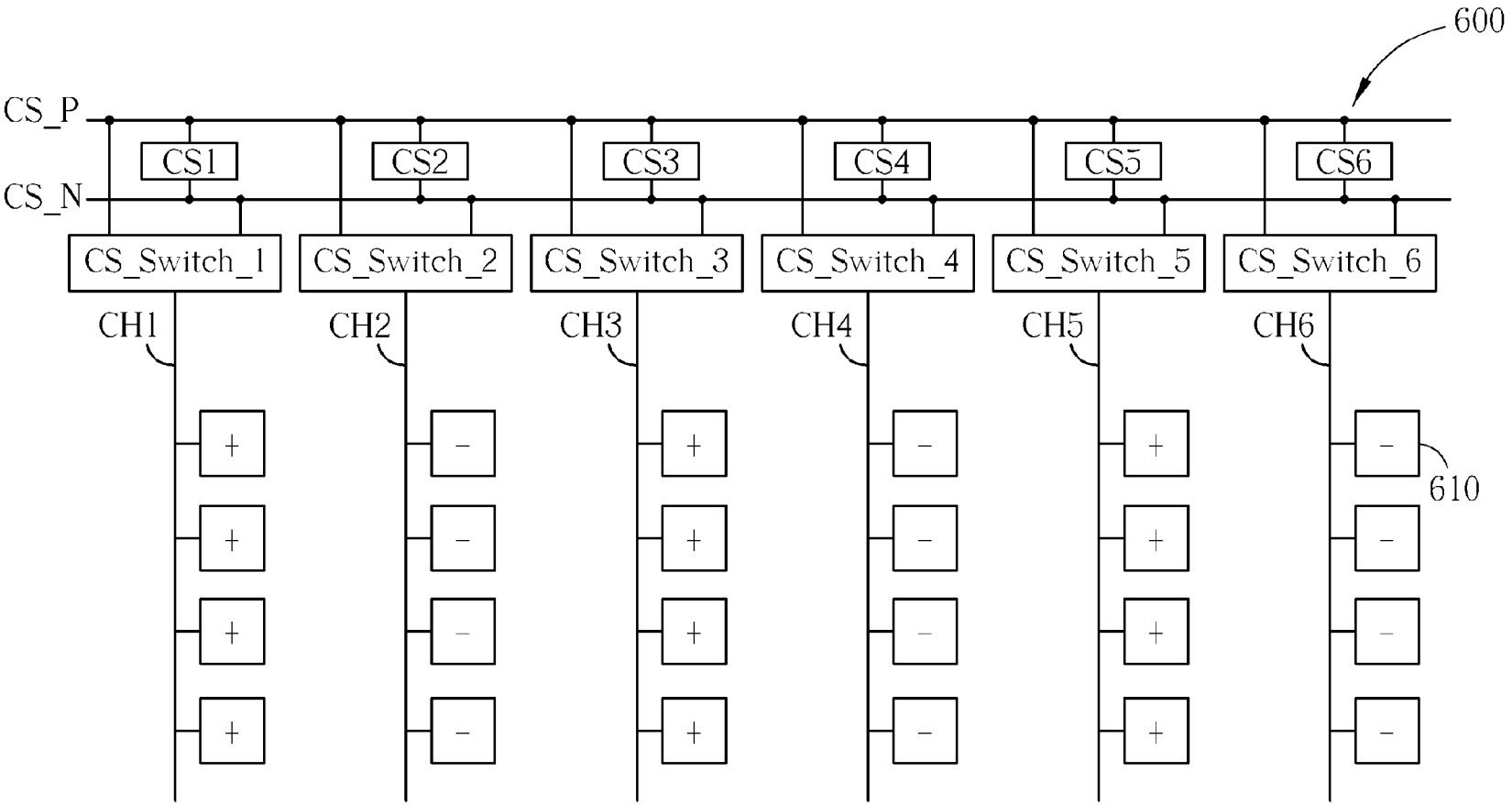
FIG. 6 illustrates an arrangement of polarity of pixels in "column inversion" style according to an embodiment of the present invention.
Figure 7:
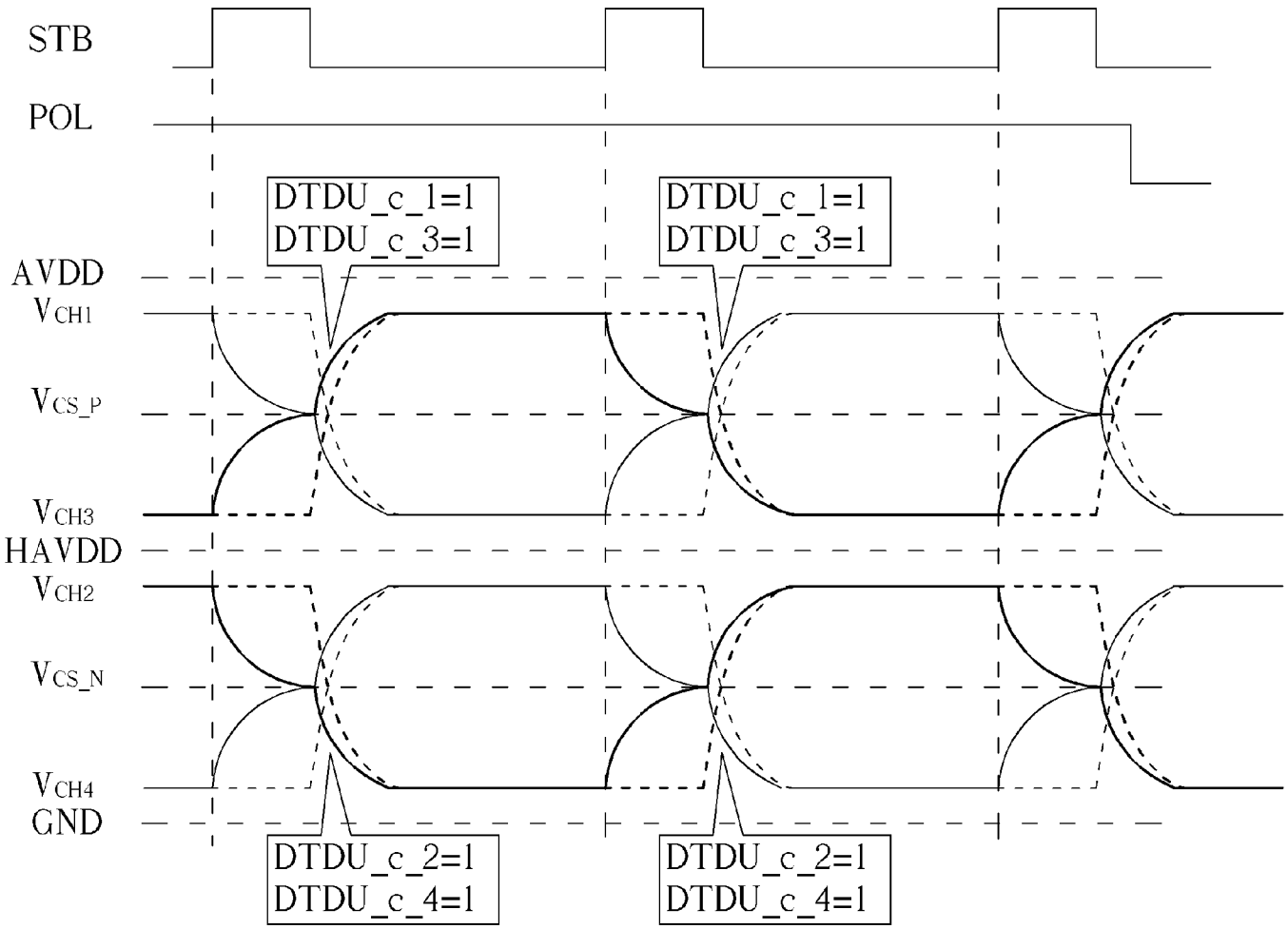
FIG. 7 illustrates a waveform diagram of signals corresponding to the pixels with polarities arranged in column inversion style shown in FIG. 6.
Figure 8:
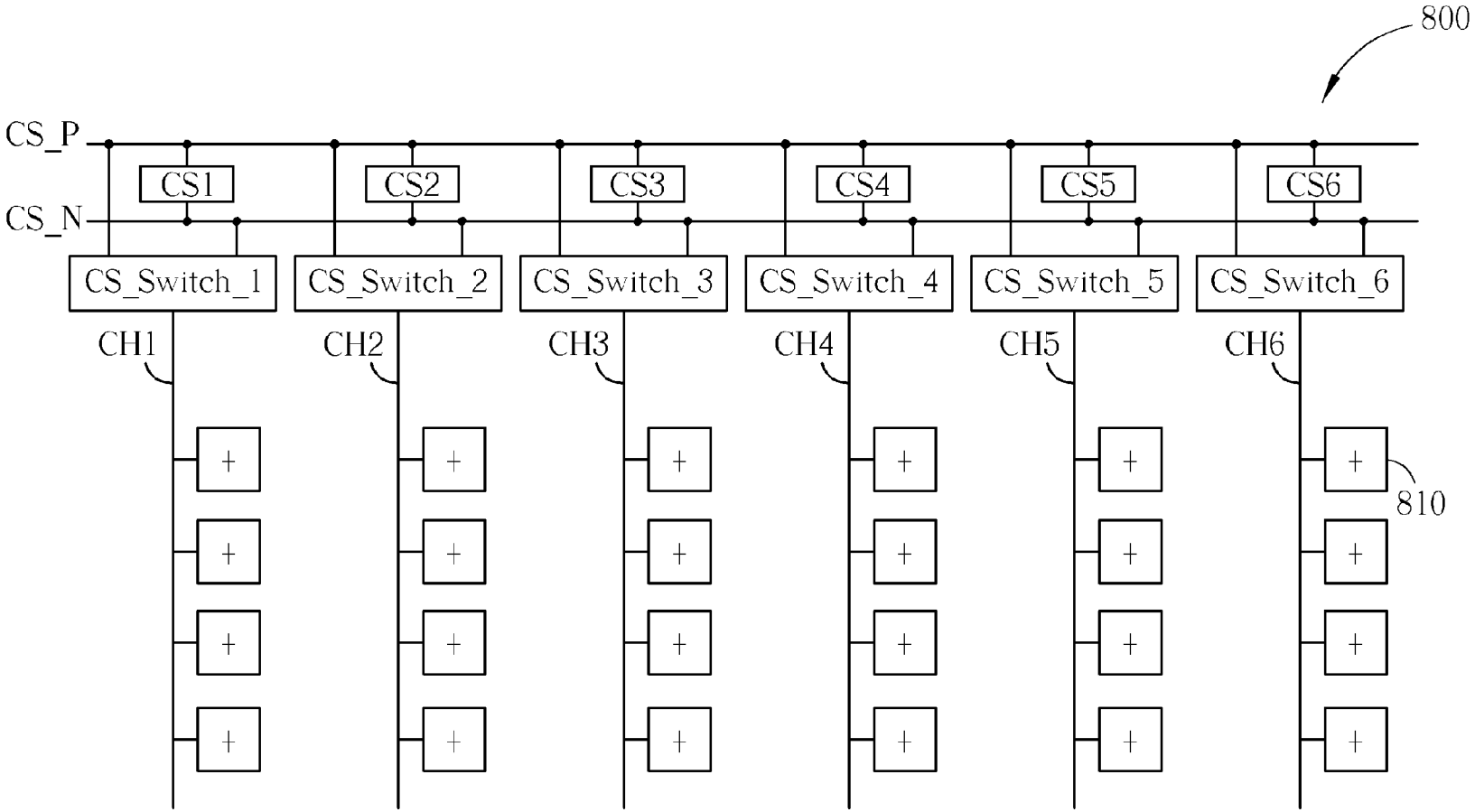
FIG. 8 illustrates an arrangement of polarity of pixels in "frame inversion" style according to an embodiment of the present invention.
Figure 9:
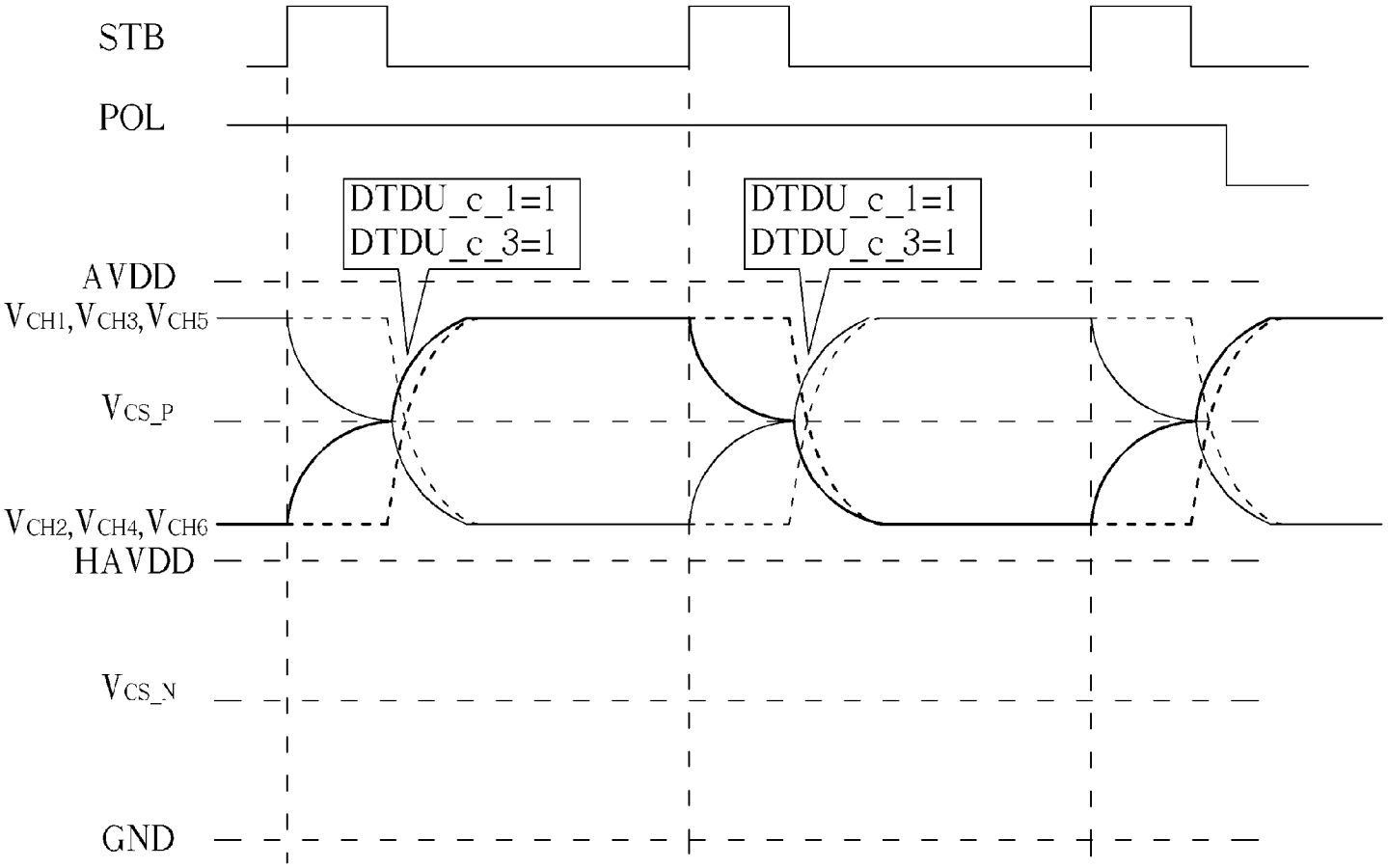
FIG. 9 illustrates a waveform diagram of signals corresponding to the pixels with polarities arranged in the frame inversion style shown in FIG. 8.

Refer to FIG. 6 to FIG. 12. The data lines CH1 to CH6 are data lines of the display devices 600, 800, 1000 and 1200 shown in FIG. 6, FIG. 8, FIG. 10 and FIG. 12 respectively, and the pixels 610, 810, 1010 and 1210 are pixels of the display devices 600, 800, 1000 and 1200 shown in FIG. 6, FIG. 8, FIG. 10 and FIG. 12 respectively and coupled to corresponding data lines. In FIG. 7, FIG. 9 and FIG. 13, the data variation signal DTDU_c_1 is the data variation signal corresponding to the data line CH1, and the data variation signal DTDU_c_1 may be 1 when the sample data signal sampled from the data line CH1 with a different MSB from the MSB of the previous sample data signal. Likewise, the data variation signals DTDU_c_2 to DTDU_c_4 are the data variation signals corresponding to the data lines CH2 to CH4. The data signal charge share units CS_Switch_1 to CS_Switch_6 are connected to the data lines CH1 to CH6 respectively. The charge share units CS1 to CS6 are corresponding to the data lines CH1 to CH6 respectively.

FIG. 6 illustrates an arrangement of polarity of pixels in "column inversion" style according to an embodiment of the present invention. According to FIG. 6, pixels arranged in a same line are of a same polarity, and the polarity is opposite to the polarity of the pixels arranged in an adjacent line. FIG. 7 illustrates a waveform diagram of signals corresponding to the pixels with polarities arranged in column inversion style shown in FIG. 6. The power supply voltage level AVDD is a voltage level of the power supply, and the ground voltage level GND is a voltage level of the ground. The half power supply voltage level HAVDD is a half value of the power supply voltage level AVDD and may be used to be a predetermined voltage level corresponding to the predetermined voltage level $V_{threshold}$ shown in FIG. 5. $V_{CS_P}$ is the first charge share voltage level, and $V_{CN_N}$ is the second charge share voltage level. $V_{CH1}$ to $V_{CH4}$ are the data line voltage levels of the data lines CH1 to CH4 in FIG. 6 respectively. According to FIG. 7, the pixels coupled to the data lines CH1 and CH3 are with positive polarity, so a second charge sharing may be performed for connecting the data lines CH1 and CH3 to the charge share line CS_P when the voltage level on the pixels changes so that the corresponding MSB changes. According to FIG. 7, the pixels coupled to the data lines CH2 and CH4 are with negative polarity, so the second charge sharing may be performed for connecting the data lines CH2 and CH4 to the charge share line CS_N when the voltage level on the pixels changes so that the corresponding MSB changes.

FIG. 8 illustrates an arrangement of polarity of pixels in "frame inversion" style according to an embodiment of the present invention. According to FIG. 8, all pixels are with a same polarity in one frame and updated to have an opposite polarity in the next frame. FIG. 9 illustrates a waveform diagram of signals corresponding to the pixels with polarities arranged in the frame inversion style shown in FIG. 8. The charge sharing operation shown in FIG. 9 is similar to what shown in FIG. 7, so the related details are not described repeatedly. In FIG. 8, all the pixels coupled to the data lines CH1 to CH6 are with the positive polarity, so the data lines are all coupled to the first charge share voltage level $V_{CS_P}$ when the charge sharing is performed.

Figure 10:
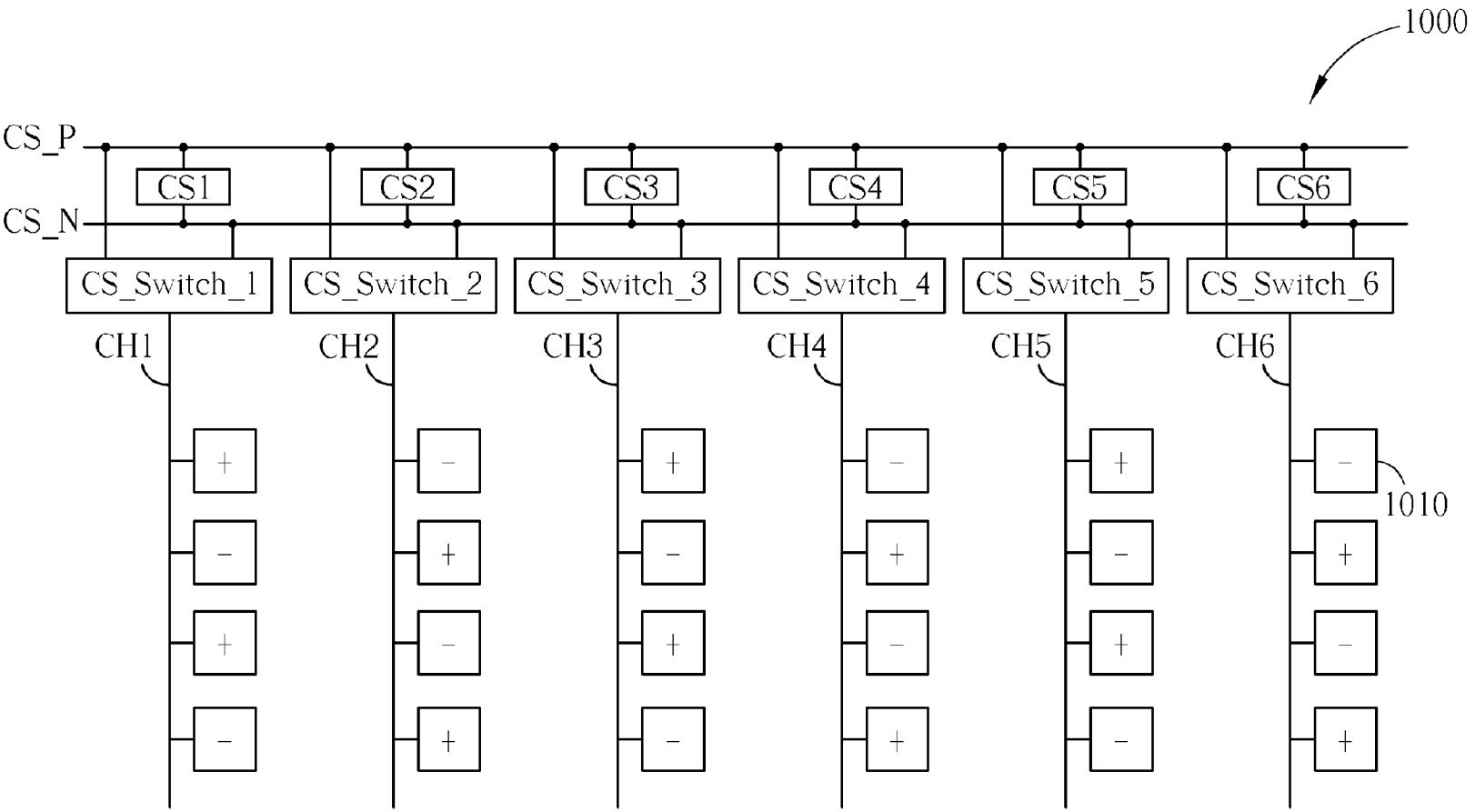
FIG. 10 illustrates an arrangement of polarity of pixels in "dot inversion" style according to an embodiment of the present invention.
Figure 11:
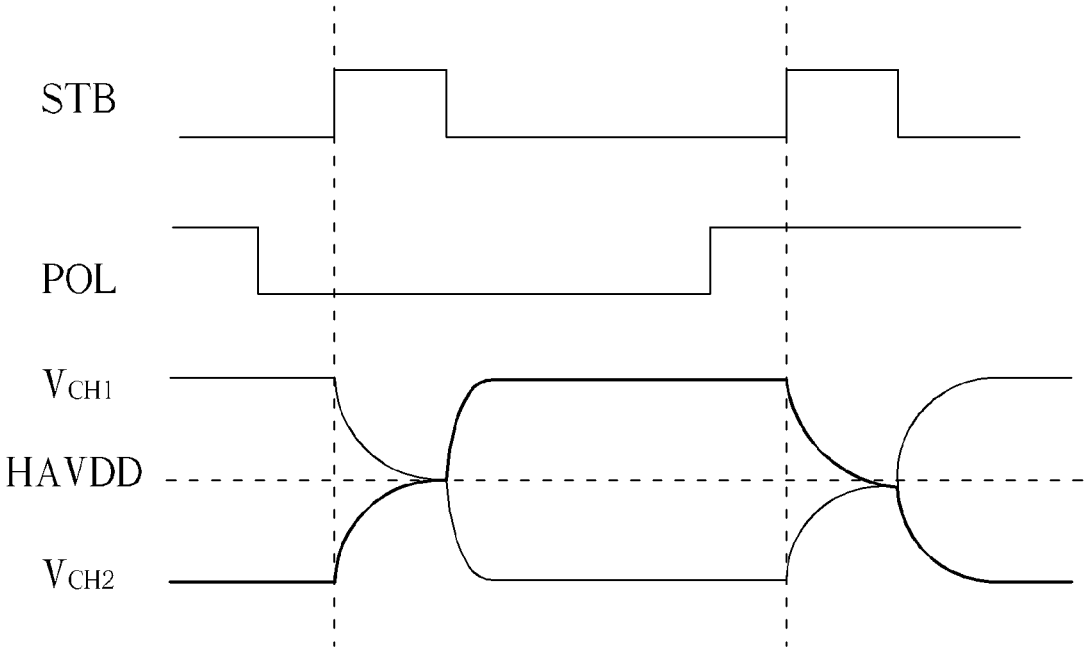
FIG. 11 illustrates a waveform diagram of signals corresponding to the pixels with polarity arranged in the dot inversion style shown in FIG. 10.

FIG. 10 illustrates an arrangement of polarity of pixels in "dot inversion" style according to an embodiment of the present invention. According to FIG. 8, each pixel has a polarity opposite to the polarity of adjacent pixels placed at its upper side, lower side, left side and right side. FIG. 11 illustrates a waveform diagram of signals corresponding to the pixels with polarity arranged in the dot inversion style shown in FIG. 10. Since each pixel in FIG. 9 has a polarity opposite to the adjacent pixels, when performing a charge sharing, only the first charge sharing is performed. Take the embodiment shown in FIG. 11 for example, performing the first charge sharing is to turned on the charge share units CS1 and CS2 for the data lines CH1 and CH2, the first charge share line CS_P and the second charge share line CS_N to be coupled to one another so as to pull the data line voltage levels $V_{CH1}$ and $V_{CH2}$ to the half power supply voltage level HAVDD.

Figure 12:
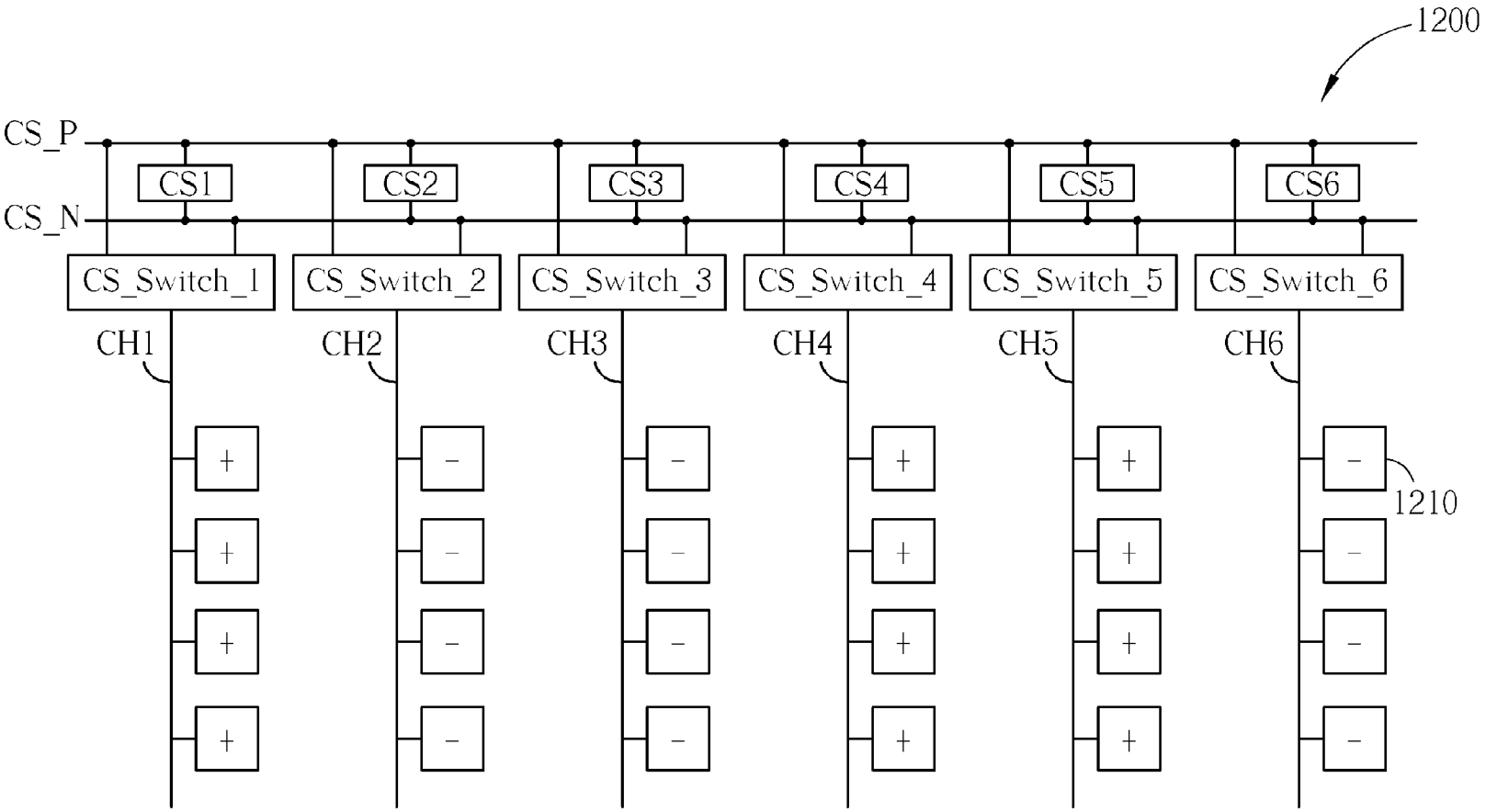
FIG. 12 illustrates an arrangement of polarity of pixels in "2V+1 inversion" style according to an embodiment of the present invention.
Figure 13:
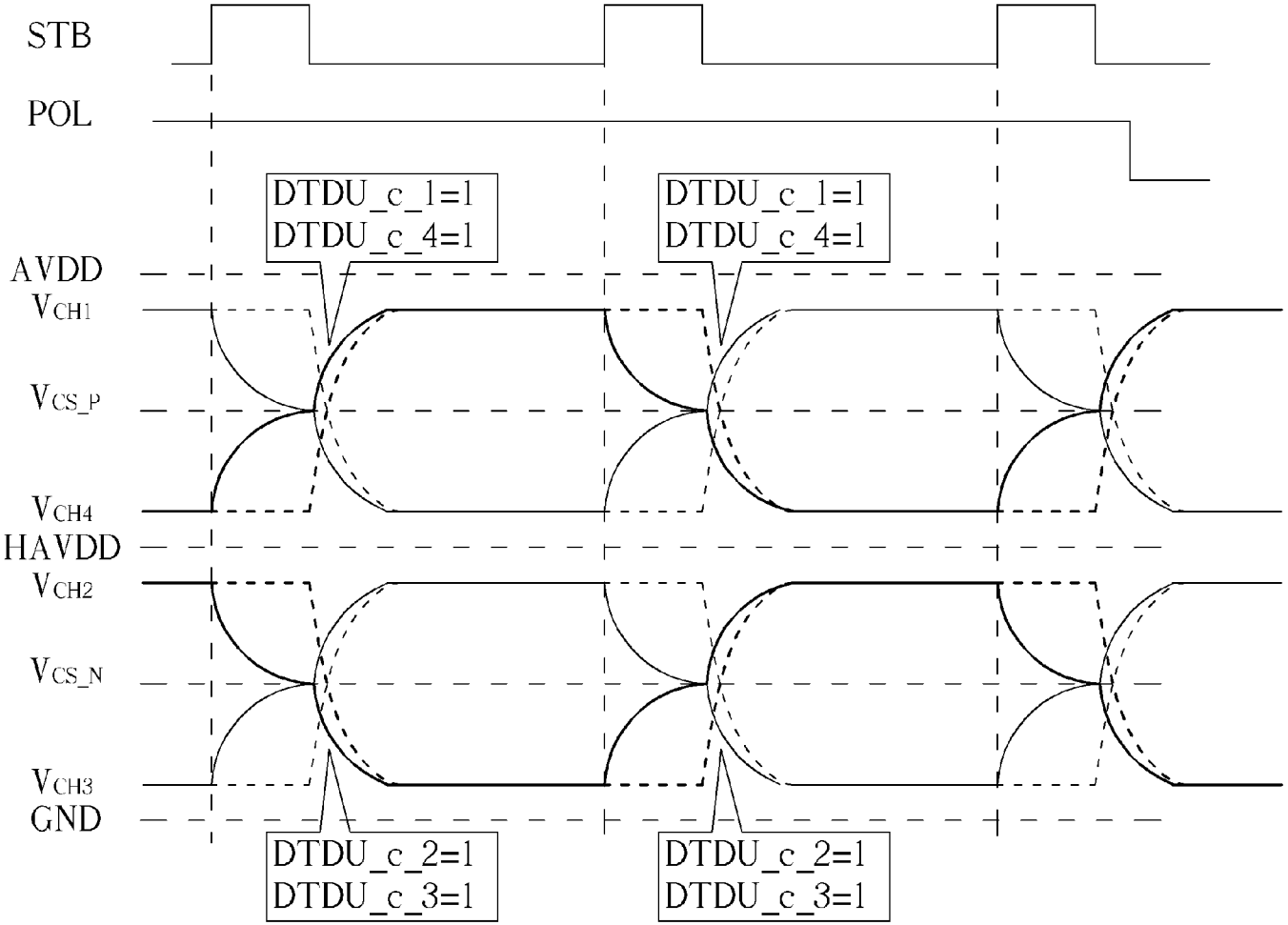
FIG. 13 illustrates a waveform diagram of signals corresponding to the pixels with polarity arranged in the 2V+1 inversion style shown in FIG. 12.

FIG. 12 illustrates an arrangement of polarity of pixels in "2V+1 inversion" style according to an embodiment of the present invention. According to FIG. 10, pixels in coupled to the first data line CH1, the second data line CH2, the third data line CH3 and the fourth data line CH4 are of the positive polarity, the negative polarity, the negative polarity and the positive polarity respectively. It is allowed to independently decide whether performing the first charge sharing (when the polarity of a data line changes) and/or the second charge sharing (when the polarity does not change but the variation of the data line voltage level is larger than a predetermined value) for the data line according to the embodiment shown in FIG. 12. FIG. 13 illustrates a waveform diagram of signals corresponding to the pixels with polarity arranged in the 2V+1 inversion style shown in FIG. 12. The charge sharing operation shown in FIG. 13 is similar to what shown in FIG. 7, so the related details are not described repeatedly. The pixels coupled to the data lines CH1 and CH4 are of the positive polarity while the pixels coupled to the data lines CH2 and CH3 are of the negative polarity, hence the data line voltage levels $V_{CH1}$ and $V_{CH4}$ are pulled to the charge share voltage level $V_{CS_P}$ while the data line voltage levels $V_{CH2}$ and $V_{CH3}$ are pulled to the charge share voltage level $V_{CS_N}$ when performing the charge sharing.

According to FIG. 6 to FIG. 13, the data driver and the driving method disclosed by embodiments of the present invention may be used with different arrangements of pixel polarity.

Figure 14:
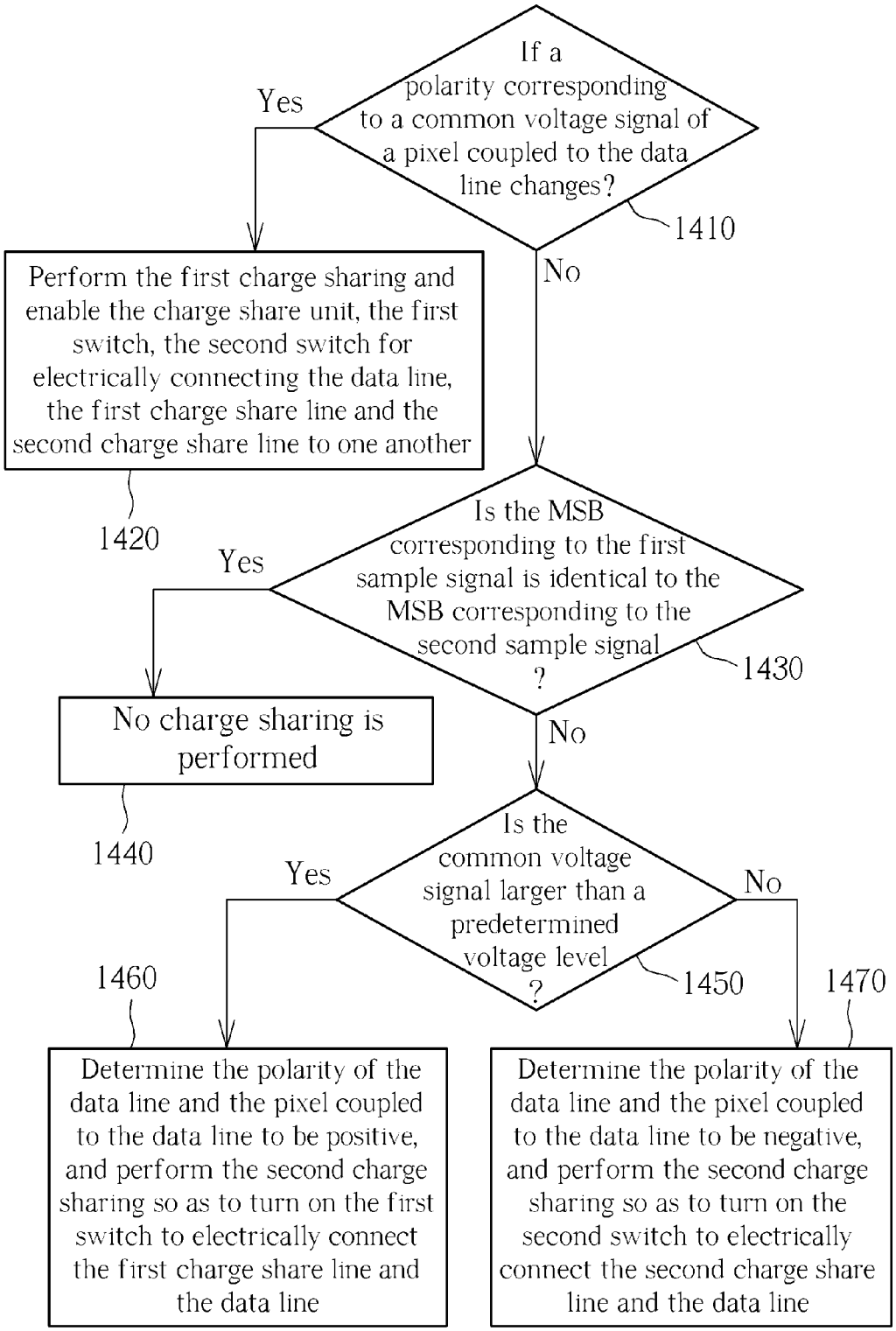
FIG. 14 illustrates a flow chart of a display device driving method according an embodiment of the present invention.

FIG. 14 illustrates a flow chart of a display device driving method according an embodiment of the present invention. FIG. 14 may be referred with FIG. 2 and FIG. 3. The driving method includes the following steps:

Step 1410: If a polarity corresponding to a common voltage signal POL of a pixel coupled to the data line CH2*a* changes? If yes, enter step 1420; if no, enter step 1430;

Step 1420: Perform the first charge sharing and enable the charge share unit CS, the first switch SW1, the second switch SW2 for electrically connecting the data line CH2*a*, the first charge share line CS_P and the second charge share line CS_N to one another;

Step 1430: Is the MSB corresponding to the first sample signal S1 is identical to the MSB corresponding to the second sample signal S2? If yes, enter step 1440; if no, enter step 1450;

Step 1440: No charge sharing is performed.

Step 1450: Is the common voltage signal POL larger than a predetermined voltage level? If yes, enter step 1460; if no, enter step 1470;

Step 1460: Determine the polarity of the data line CH2*a* and the pixel coupled to the data line CH2*a* to be positive, and perform the second charge sharing so as to turn on the first switch SW1 to electrically connect the first charge share line CS_P and the data line CH2*a*.

Step 1470: Determine the polarity of the data line CH2*a* and the pixel coupled to the data line CH2*a* to be negative, and perform the second charge sharing so as to turn on the second switch SW2 to electrically connect the second charge share line CS_N and the data line CH2*a*.

Figure 15:
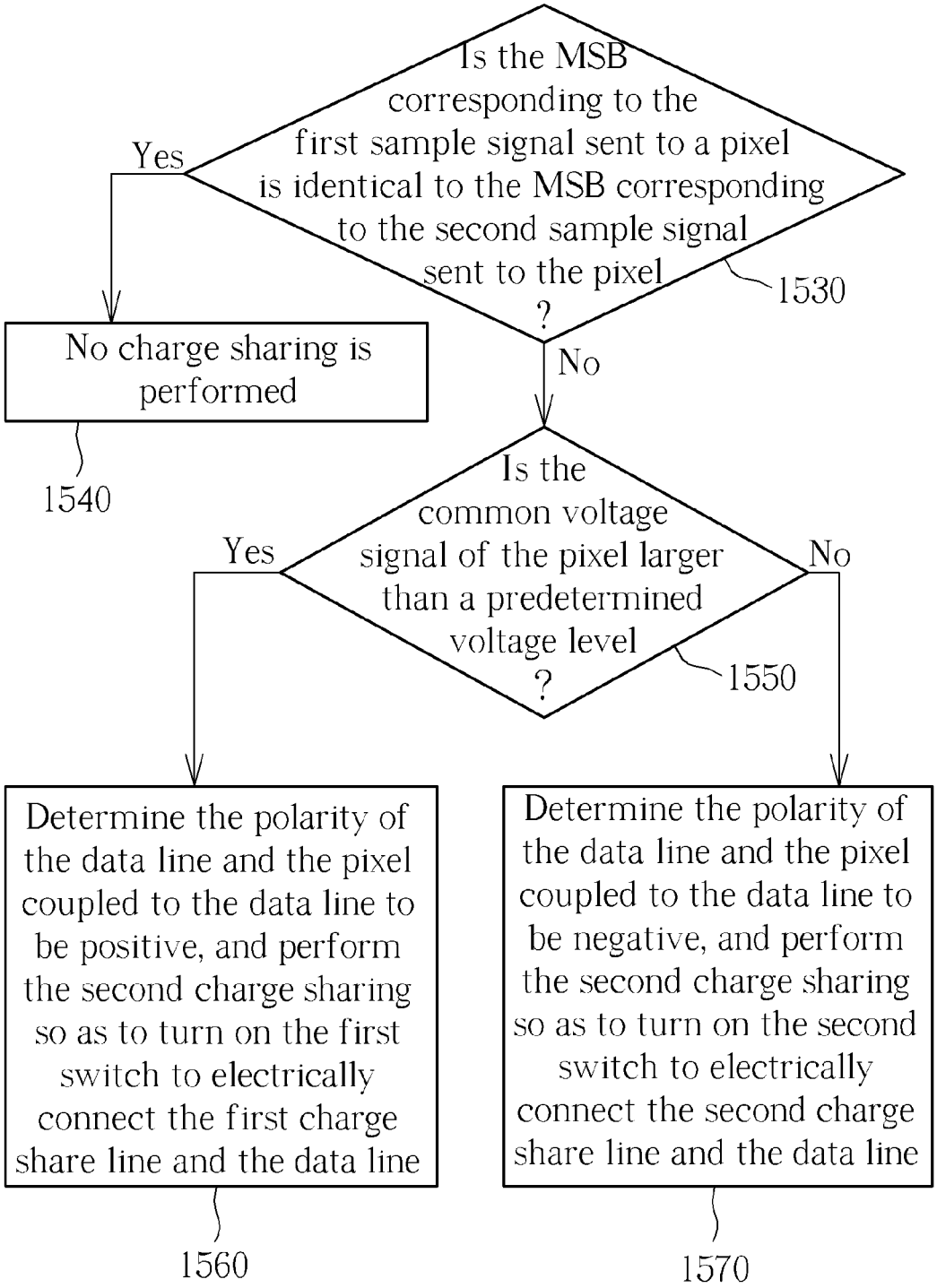
FIG. 15 illustrates a flow chart of a display device driving method according another embodiment of the present invention.

FIG. 15 illustrates a flow chart of a display device driving method according another embodiment of the present invention. FIG. 15 may be referred with FIG. 2 and FIG. 3. In the driving method shown in FIG. 15, merely the second charge sharing is performed. The driving method includes the following steps:

Step 1530: Is the MSB corresponding to the first sample signal S1 sent to a pixel is identical to the MSB corresponding to the second sample signal S2 sent to the pixel? If yes, enter step 1540; if no, enter step 1550;

Step 1540: No charge sharing is performed.

Step 1550: Is the common voltage signal POL of the pixel larger than a predetermined voltage level? If yes, enter step 1560; if no, enter step 1570;

Step 1560: Determine the polarity of the data line CH2*a* and the pixel coupled to the data line CH2*a* to be positive, and perform the second charge sharing so as to turn on the first switch SW1 to electrically connect the first charge share line CS_P and the data line CH2*a*.

Step 1570: Determine the polarity of the data line CH2*a* and the pixel coupled to the data line CH2*a* to be negative, and perform the second charge sharing so as to turn on the second switch SW2 to electrically connect the second charge share line CS_N and the data line CH2*a*.

In summary, by using the data driver and the display device driving method, a charge sharing is allowed to be performed when the polarity of a data line and pixels coupled to the data line does not change, so the power consumption may be reduced. According to a software simulation, the power consumption caused by switching the voltage level on data lines and pixels may be reduced by 50%. Compared to the prior art, the data driver and the display device driving method disclosed by the present invention brings substantial improvement.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. An electric charge share device, electrically connected to a data driver and a data line, comprising:
- a data detection unit configured to determine if a most-significant-bit of a first sample data signal from the data driver is identical to a most-significant-bit of a second sample data signal from the data driver;
- a first charge share line;
- a second charge share line; and
- a data signal charge share unit configured to receive a data signal from the data driver, electrically connected to the data detection unit, the first charge share line and the second charge share line, and comprising:
  - a first switch comprising:
    - a first terminal coupled to the first charge share line;
    - a second terminal coupled to the data line; and
    - a control terminal;
  - a second switch comprising:
    - a first terminal coupled to the second charge share line;
    - a second terminal coupled to the data line; and
    - a control terminal;
  - a first logic unit, coupled to the control terminal of the first switch; configured to control if the first switch is turned on according to whether a polarity of the data line changes, the polarity of the data line, and whether a difference between the first sample data signal and the second sample data signal is larger than a predetermined value; and comprising:
    - a first OR-gate, comprising:
      - a first input terminal configured to receive a polarity switch signal so as to be informed whether the polarity of the data line changes;
      - a second input terminal; and
      - an output terminal coupled to the control terminal of the first switch; and
    - a first AND-gate, comprising:
      - a first input terminal coupled to the data detection unit;
      - a second input terminal coupled to the polarity comparator; and
      - an output terminal coupled to the second input terminal of the first OR-gate;
  - a second logic unit, coupled to the control terminal of the second switch; configured to control if the second switch is turned on according to whether the polarity of the data line changes, the polarity of the data line, and whether the difference between the first sample data signal and the second sample data signal is larger than the predetermined value; and comprising:
    - a second OR-gate, comprising:
      - a first input terminal configured to receive the polarity switch signal so as to be informed whether the polarity of the data line changes;
      - a second input terminal; and
      - an output terminal coupled to the control terminal of the second switch;
    - a second AND-gate, comprising:
      - a first input terminal coupled to the data detection unit;
      - a second input terminal; and
      - an output terminal coupled to the second input terminal of the second OR-gate; and
    - an inverter, comprising:
      - an input terminal coupled to the polarity comparator; and
      - an output terminal coupled to the second input terminal of the second AND-gate; and
  - a polarity comparator, configured to compare the data signal with a voltage value with a predetermined voltage level so as to determine the polarity of the data line and the pixel coupled to the data line, comprising:
    - a first terminal coupled to the data line;
    - a second terminal coupled to the predetermined voltage level; and
    - an output terminal coupled to the first logic unit and the second logic unit;
- wherein when the most-significant-bit of the first sample data signal is not identical to the most-significant-bit of the second sample data signal, the data line is selectively coupled to the first charge share line or the second charge share line according to a polarity of a common voltage signal of a pixel connected to the data line.

2. The electric charge share device of claim 1, further comprising:
- a capacitor comprising:
  - a first terminal electrically connected to the first charge share line, and
  - a second terminal connected to a ground.

3. The electric charge share device of claim 1, further comprising:
- a capacitor comprising:
  - a first terminal electrically connected to the second charge share line, and
  - a second terminal connected to a ground.

4. The electric charge share device of claim 1, further comprising:
- a capacitor comprising:
  - a first terminal electrically connected to the first charge share line, and
  - a second terminal connected to the second charge share line.

5. A data driver, electrically connected to a data line, comprising:
- a first latch configured to output a first sample data signal;
- a second latch electrically connected to the first latch and configured to output a second sample data signal;
- a digital-to-analog convertor electrically connected to the second latch and configured to output a data signal to a pixel coupled to the data line;
- a data detection unit coupled to the first latch and the second latch and configured to receive the first sample data signal and the second sample data signal;
- a first charge share line;
- a second charge share line; and
- a data signal charge share unit coupled to the data line, the data detection unit, the first charge share line and the second charge share line, and comprising:
  - a first switch comprising:
    - a first terminal coupled to the first charge share line;
    - a second terminal coupled to the data line; and
    - a control terminal;
  - a second switch comprising:
    - a first terminal coupled to the second charge share line;
    - a second terminal coupled to the data line; and
    - a control terminal;

a first logic unit, coupled to the control terminal of the first switch; configured to control if the first switch is turned on according to whether a polarity of the data line changes, the polarity of the data line, and whether a difference between the first sample data signal and the second sample data signal is larger than a predetermined value; and comprising:

a first OR-gate, comprising:

a first input terminal configured to receive a polarity switch signal so as to be informed whether the polarity of the data line changes;

a second input terminal; and an output terminal coupled to the control terminal of the first switch; and a first AND-gate, comprising:

a first input terminal coupled to the data detection unit;

a second input terminal coupled to the polarity comparator; and an output terminal coupled to the second input terminal of the first OR-gate;

a second logic unit, coupled to the control terminal of the second switch; configured to control if the second switch is turned on according to whether the polarity of the data line changes, the polarity of the data line, and whether the difference between the first sample data signal and the second sample data signal is larger than the predetermined value; and comprising:

a second OR-gate, comprising:

a first input terminal configured to receive the polarity switch signal so as to be informed whether the polarity of the data line changes;

a second input terminal; and an output terminal coupled to the control terminal of the second switch;

a second AND-gate, comprising:

a first input terminal coupled to the data detection unit;

a second input terminal; and an output terminal coupled to the second input terminal of the second OR-gate; and an inverter, comprising:

an input terminal coupled to the polarity comparator; and an output terminal coupled to the second input terminal of the second AND-gate; and a polarity comparator, configured to compare the data signal with a voltage value with a predetermined voltage level so as to determine the polarity of the data line and the pixel coupled to the data line, comprising:

a first terminal coupled to the data line;

a second terminal coupled to the predetermined voltage level; and an output terminal coupled to the first logic unit and the second logic unit;

wherein when the most-significant-bit of the first sample data signal is not identical to the most-significant-bit of the second sample data signal, the data line is selectively coupled to the first charge share line or the second charge share line according to a polarity of a common voltage signal of the pixel coupled to the data line.

6. The data driver of claim 5, further comprising:

a polarity determination unit configured to output a polarity switch signal when the polarity of the common voltage signal of the pixel changes.

7. The data driver of claim 5, further comprising:

a charge share unit coupled to the first charge share line and the second charge share line;

wherein the charge share unit and the data signal charge share unit are enabled when the polarity of the common voltage signal of the pixel changes.

8. The data driver of claim 5, further comprising:

a capacitor comprising:

a first terminal electrically connected to the first charge share line, and a second terminal electrically connected to a ground.

9. The data driver of claim 5, further comprising:

a capacitor comprising:

a first terminal electrically connected to the second charge share line, and a second terminal electrically connected to a ground.

10. The data driver of claim 5, further comprising:

a capacitor comprising:

a first terminal electrically connected to the first charge share line, and a second terminal electrically connected to the second charge share line.

* * * * *